US006927546B2

(12) United States Patent
Adamson et al.

(10) Patent No.: US 6,927,546 B2
(45) Date of Patent: Aug. 9, 2005

(54) LOAD CONTROL SYSTEM AND METHOD

(75) Inventors: Hugh P. Adamson, Boulder, CO (US); Scott Hesse, Longmont, CO (US); William Nicolay, Loveland, CO (US)

(73) Assignee: Colorado vNet, LLC, Loveland, CO (US)

( * ) Notice: Subject to any disclaimer, the term of this patent is extended or adjusted under 35 U.S.C. 154(b) by 0 days.

(21) Appl. No.: 10/424,345

(22) Filed: Apr. 28, 2003

(65) Prior Publication Data

US 2004/0212325 A1 Oct. 28, 2004

(51) Int. Cl.[7] ..... H05B 37/00
(52) U.S. Cl. ..... 315/312
(58) Field of Search ..... 315/291, 307, 315/224, 312, 347, 349, 350

(56) References Cited

U.S. PATENT DOCUMENTS

| | | | | |
|---|---|---|---|---|
| 3,746,923 A | * | 7/1973 | Spira et al. | 315/291 |
| 3,925,633 A | * | 12/1975 | Partridge | 219/625 |
| 4,331,225 A | | 5/1982 | Bolger | 191/10 |
| 4,766,481 A | | 8/1988 | Gobrecht et al. | 357/80 |
| 4,788,398 A | * | 11/1988 | Hornung | 219/483 |
| 4,803,380 A | | 2/1989 | Jacoby, Jr. et al. | 307/157 |
| 4,816,647 A | * | 3/1989 | Payne | 219/448.12 |
| 4,858,054 A | | 8/1989 | Franklin | 361/57 |
| 4,889,999 A | | 12/1989 | Rowen | 307/31 |
| 5,327,047 A | | 7/1994 | Gershen | 315/194 |
| 5,339,217 A | | 8/1994 | Cohen et al. | 361/707 |
| 5,430,356 A | | 7/1995 | Ference et al. | 315/291 |
| 5,432,303 A | | 7/1995 | Turek et al. | 174/259 |
| 5,467,251 A | | 11/1995 | Katchmar | 361/719 |
| 5,510,975 A | | 4/1996 | Ziegler, Jr. | |
| 5,528,215 A | | 6/1996 | Siu et al. | |
| 5,551,053 A | | 8/1996 | Nadolski et al. | |
| 5,572,438 A | | 11/1996 | Ehlers et al. | 364/492 |
| 5,579,221 A | | 11/1996 | Mun | |
| 5,602,728 A | | 2/1997 | Madden et al. | 364/145 |
| 5,621,662 A | | 4/1997 | Humphries et al. | |

(Continued)

OTHER PUBLICATIONS

Luca Stagnaro, "HurriCANe: VHDL CAN Controller core", Mar. 2000, Spacecraft Control and Data Systems Division, Automation and Information Dept., European Space Agency.

(Continued)

*Primary Examiner*—Don Wong
*Assistant Examiner*—Minh Dieu A
(74) *Attorney, Agent, or Firm*—Trenner Law Firm, LLC

(57) ABSTRACT

A load control systems and methods. One embodiment of a load control system comprises at least two triac devices connected in parallel to a load, the at least two triac devices operable to deliver current to the load. At least one driver circuit is linked to the at least two triac devices. A controller is linked to the at least one driver circuit, the controller signaling the at least one driver circuit to actuate the at least two triac devices at about the same time.

33 Claims, 9 Drawing Sheets

U.S. PATENT DOCUMENTS

| | | | | | |
|---|---|---|---|---|---|
| 5,664,101 | A | | 9/1997 | Picache | 395/200.8 |
| 5,703,442 | A | | 12/1997 | Notohamiprodjo et al. | |
| 5,784,547 | A | | 7/1998 | Dittmar et al. | |
| 5,808,417 | A | | 9/1998 | Ference et al. | 315/112 |
| 5,831,828 | A | | 11/1998 | Cutting et al. | 361/704 |
| 5,845,275 | A | | 12/1998 | Le Van Suu | 706/1 |
| 5,892,279 | A | | 4/1999 | Nguyen | 257/712 |
| 5,904,499 | A | | 5/1999 | Pace | 438/108 |
| 5,938,757 | A | | 8/1999 | Bertsch | |
| 5,940,387 | A | | 8/1999 | Humpleman | |
| 6,028,355 | A | | 2/2000 | Gates | 257/706 |
| 6,038,500 | A | | 3/2000 | Weiss | |
| 6,046,918 | A | | 4/2000 | Jitaru | 323/251 |
| 6,191,563 | B1 | * | 2/2001 | Bangerter | 323/211 |
| 6,192,282 | B1 | | 2/2001 | Smith et al. | |
| 6,199,136 | B1 | | 3/2001 | Shteyn | |
| 6,211,796 | B1 | * | 4/2001 | Toms et al. | 340/825.49 |
| 6,263,260 | B1 | | 7/2001 | Bodmer et al. | |
| 6,292,862 | B1 | | 9/2001 | Barrensheen et al. | |
| 6,297,724 | B1 | | 10/2001 | Bryans et al. | |
| 6,310,439 | B1 | | 10/2001 | Jacoby, Jr. et al. | 315/112 |
| 6,336,128 | B1 | | 1/2002 | Eisenmann et al. | |
| 6,342,997 | B1 | * | 1/2002 | Khadkikar et al. | 361/103 |
| 6,365,989 | B1 | | 4/2002 | O'Donnell | 307/37 |
| 6,480,480 | B1 | | 11/2002 | Du | 370/338 |
| 6,609,172 | B1 | | 8/2003 | Stringham | |
| 6,728,268 | B1 | | 4/2004 | Bird | |
| 2003/0074511 | A1 | | 4/2003 | Kramer et al. | |

OTHER PUBLICATIONS

Luca Stagnaro, "CAN Controller for HurriCANe: VHDL", Mar. 2000, Spacecraft Control and Data Systems Division, Automation and Information Dept., European Space Agency.

Luca Stagnaro, "AMBA Interface for HurriCANe: VHDL IP", Mar. 2000, Spacecraft Control and Data Systems Division, Automation and Information Dept., European Space Agency.

F. Moraes, et al., "Using the CAN Protocol and Reconfigurable Computing Technology for Web–Based Smart House Automation". Integrated Circuits and Systems Design, 2001, p. 38–43.

"CAN in Building Automation" published to the internet at http://www.can–cia.de/can/applications/buildingautomation/index.html Last modified Sep. 1, 2003, 1 pages.

"CAN Remote Automation and Control with the AVR" published to the internet at http://www.cs.unibo.it/~lanconel/projects.html As early as Dec. 13, 2002, 1 page.

"CAN Remote Automation and Control with the AVR" Published to the internet at http://caraca.sourceforge.net/ As early as Dec. 13, 2002, pp. 2–6.

"CAN Bus Megafunction" Solution Brief 22 ver. 1 Altera Corporation, San Jose CA, Sep. 1997, 3 pages.

* cited by examiner

LOAD CONTROL SYSTEM AND METHOD

FIELD OF THE INVENTION

The invention generally pertains to controlling electrical loads, and more specifically, to load control systems and methods.

BACKGROUND OF THE INVENTION

Controls for adjusting the level of artificial lighting are commonplace, ranging from the simple household dimmer switch to extensive lighting circuits used in stage productions. These lighting controls play a significant role in the ambiance of a room.

Early lighting controls relied on variable resistors to dissipate power, thereby "dimming" the lights. Although functional, these early lighting controls wasted power and generated significant heat. Modern lighting controls use triacs. Triacs function by varying the point that a load is turned on during each alternating current (AC) cycle (in the United States, AC current has 60 cycles per second). That is, triacs vary the time at which the load is switched on after zero-cross during each AC cycle. This rapid "switching" serves to reduce the total current being delivered to the lights. But this rapid switching can also cause a "buzzing" sound in the light, as well as electromagnetic interference. Accordingly, most triacs include circuits with an inductor choke and an interference capacitor.

While simple lighting controls, such as the household dimmer switch, may be suitable for controlling a few lights, other lighting circuits may require different current-capacity triacs. By way of example, a banquet hall may require one or more higher current capacity triacs than the reception area of an office. In addition, a single room may have multiple light circuits requiring different current capacity triacs. For example, a higher-current capacity triac may be provided for the main lighting circuit in a room, and another, smaller capacity triac may be provided for a perimeter lighting circuit (e.g., to illuminate artwork hanging on the walls) in the same room.

Although triacs produce less heat than the early variable resistor dimmer switches, triacs still produce heat. Logically, triacs carrying higher current produce even more heat that needs to be dissipated. Accordingly, triacs carrying higher current are provided with larger heat sinks (e.g., having fins), or even fans to dissipate the heat that is generated by the triac. However, large heat sinks and fans are not aesthetically pleasing and fans can be noisy, typically requiring that these triacs be installed in utility closets or the like.

Manufacturing different current capacity triacs is also expensive. Not only is the related circuitry (e.g., inductor chokes and interference capacitors) more expensive for higher current capacity triacs, but the manufacturer must also maintain a large inventory of different size parts for manufacturing each of the different current capacity triacs. These direct costs are passed onto the installer, who incurs further overhead by having to maintain an inventory of different current capacity triacs. Eventually, these costs are passed onto the consumer.

SUMMARY OF THE INVENTION

An embodiment of load control system may comprise at least two triac devices connected in parallel to a load, the at least two triac devices operable to deliver current to the load. At least one driver circuit is linked to the at least two triac devices. A controller is linked to the at least one driver circuit, the controller signaling the at least one driver circuit to actuate the at least two triac devices at about the same time.

An embodiment of a method for controlling at least one load may comprise the steps of: reconfigurably connecting at least one triac device in parallel with at least one other triac device for providing current to the at least one load; and actuating each of the plurality of triac devices connected in parallel at about the same time to balance the total current delivered to the at least one load substantially the same portions through each of the plurality of triac devices connected in parallel.

BRIEF DESCRIPTION OF THE DRAWINGS

Illustrative and presently preferred embodiments of the invention are shown in the drawings, in which.

DESCRIPTION OF THE PREFERRED EMBODIMENT

Embodiments of load control system 100 are shown and described herein according to the teachings of the present invention as it may be used in a building automation environment. For purposes of illustration, load control system 100 may be used to control electrical power to one or more lighting circuits, although other uses are also contemplated as being within the scope of the invention. As an example, the load control system 100 may also be used to control electrical power to electric motors that operate window coverings and ceiling fans.

Figure 1:
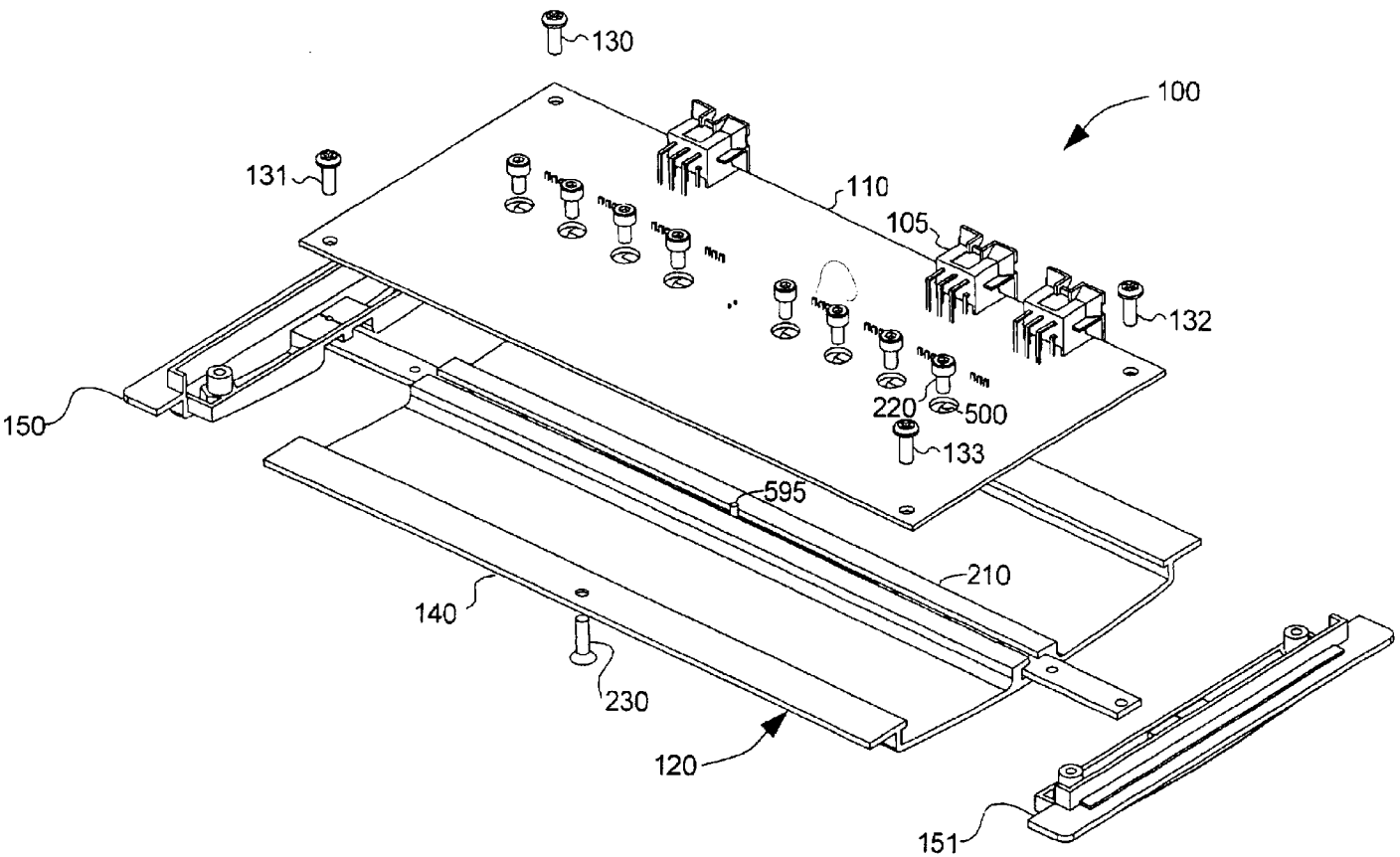
FIG. 1 is an exploded perspective view of a circuit board and a cover for one embodiment of load control system.

Load control system 100 is shown in FIG. 1 comprising a circuit board 110 for the control circuitry (e.g., triac devices 500). The control circuitry will be described in more detail below with reference to FIGS. 5(*a*) and (*b*) through FIGS. 7(*a*) and (*b*).

Figure 2:
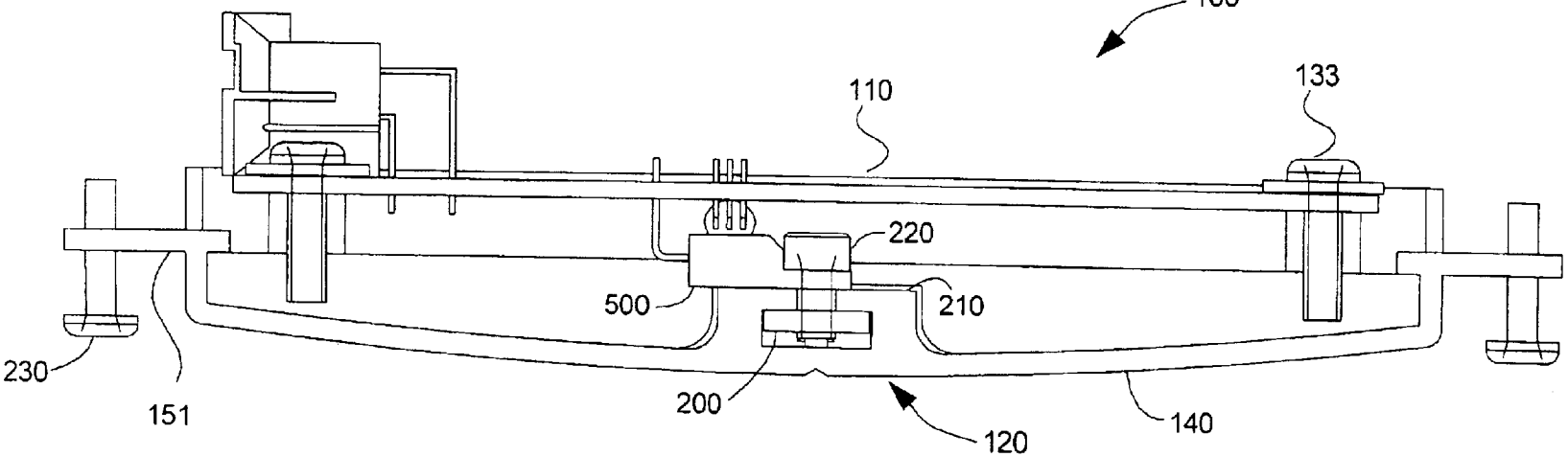
FIG. 2 is a side cross-sectional view of the circuit board mounted to the cover in FIG. 1.
Figure 3:
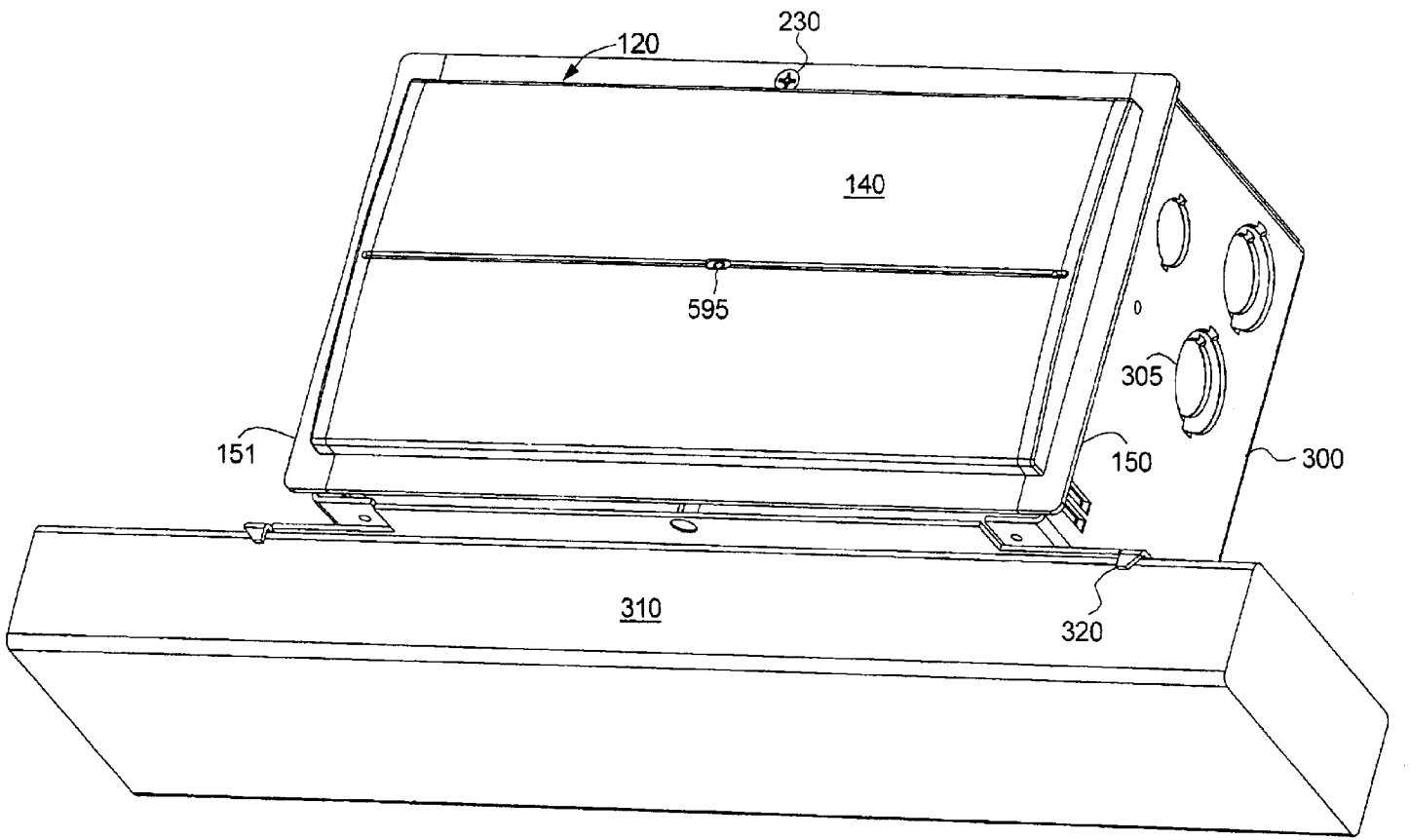
FIG. 3 is a perspective view of load control system as it may be installed in a building wall.
Figure 4:
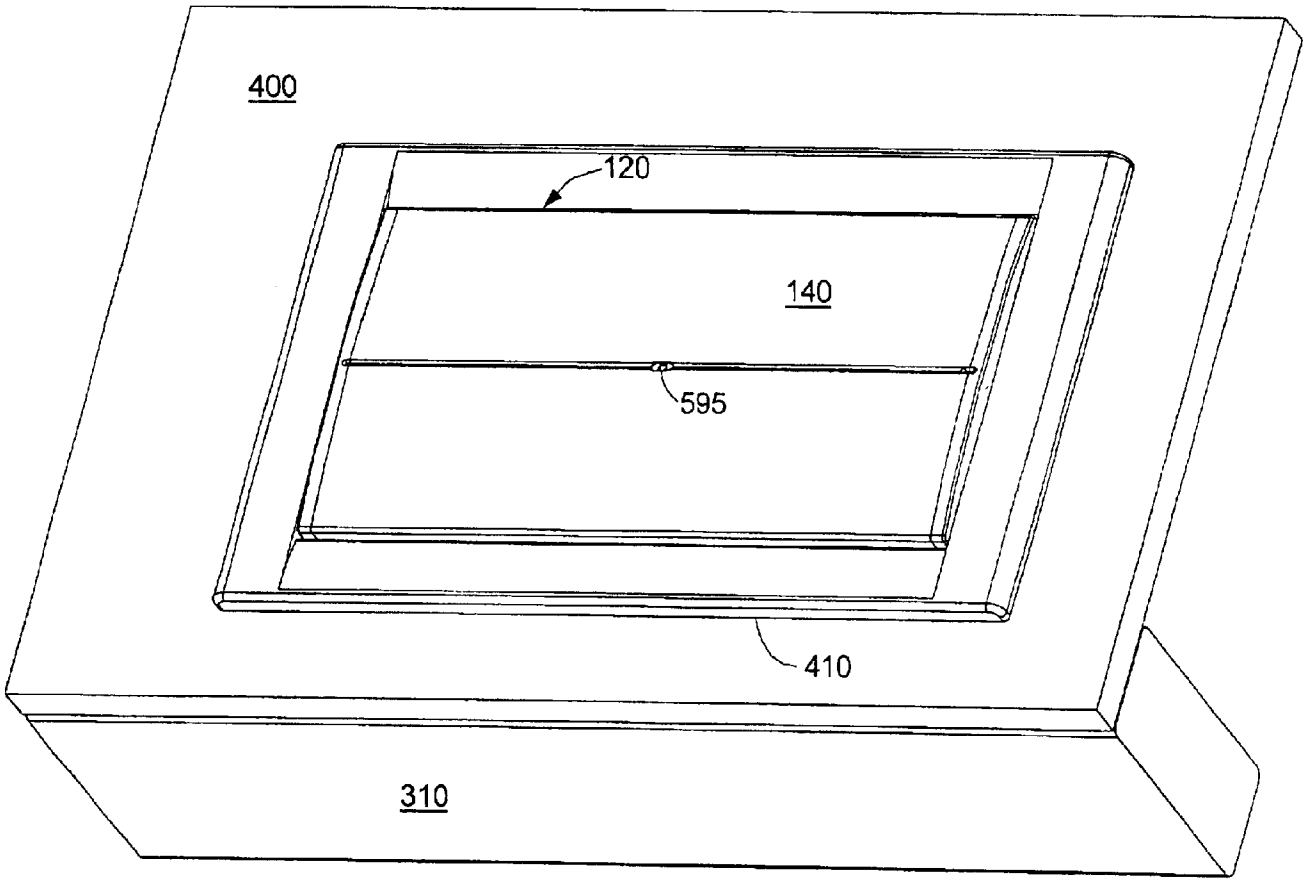
FIG. 4 is another perspective view of load control system as it may be installed in a building wall.

According to one embodiment, the circuit board 110 is mounted to a cover 120, as shown in FIG. 1 and FIG. 2, and the cover 120 is mounted to a housing 300 (FIG. 3). Accordingly, the circuit board 110 is at least partially enclosed in housing 300 and can readily be mounted in a building wall, as shown in FIG. 3 and FIG. 4.

Figure 5A:
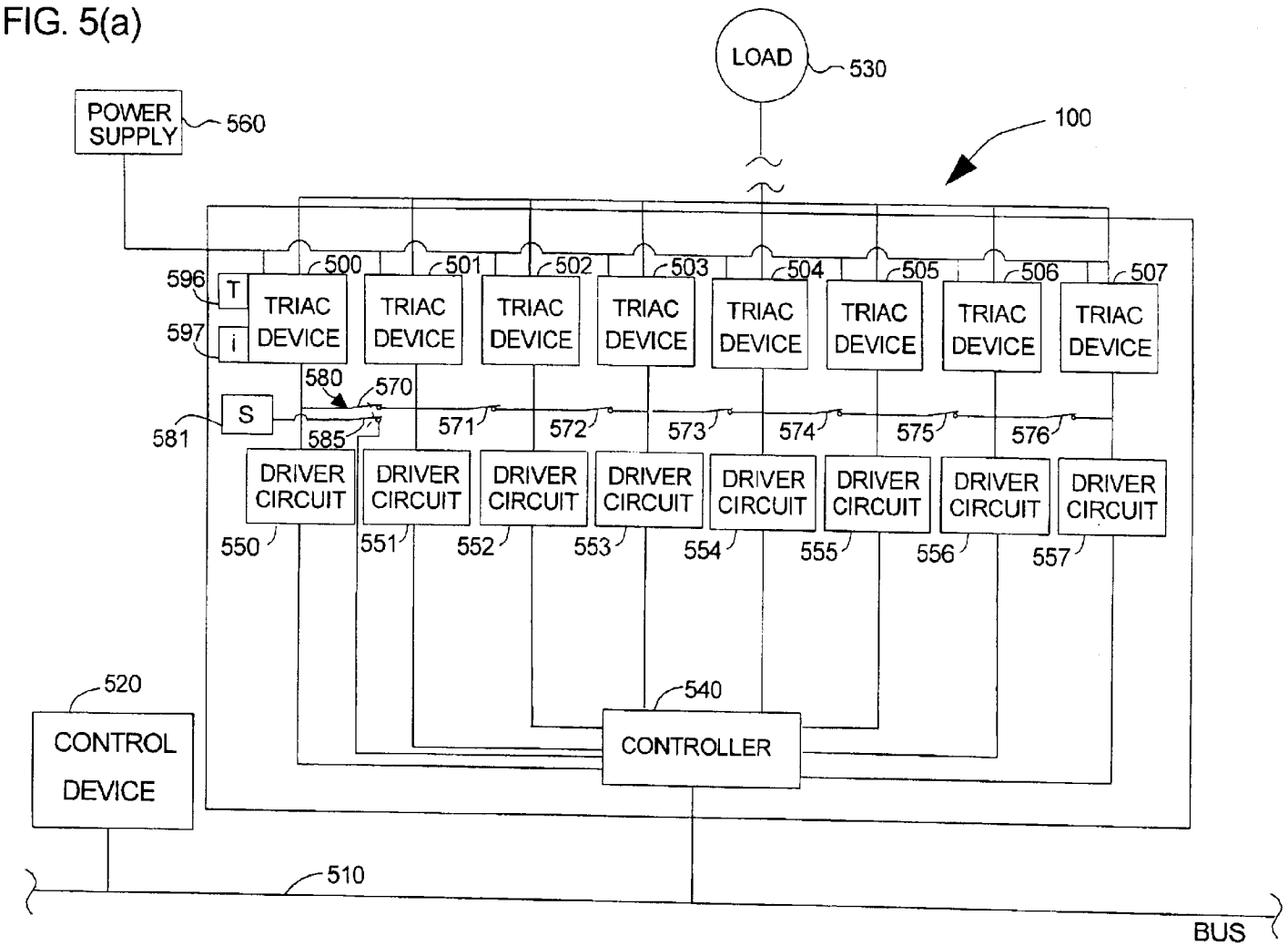
FIGS. 5(*a*) and (*b*) are high-level schematic diagrams of a load control system according to one embodiment of the invention, illustrating the load control system configured to power (a) a single load, and (b) a plurality of loads.
Figure 5B:
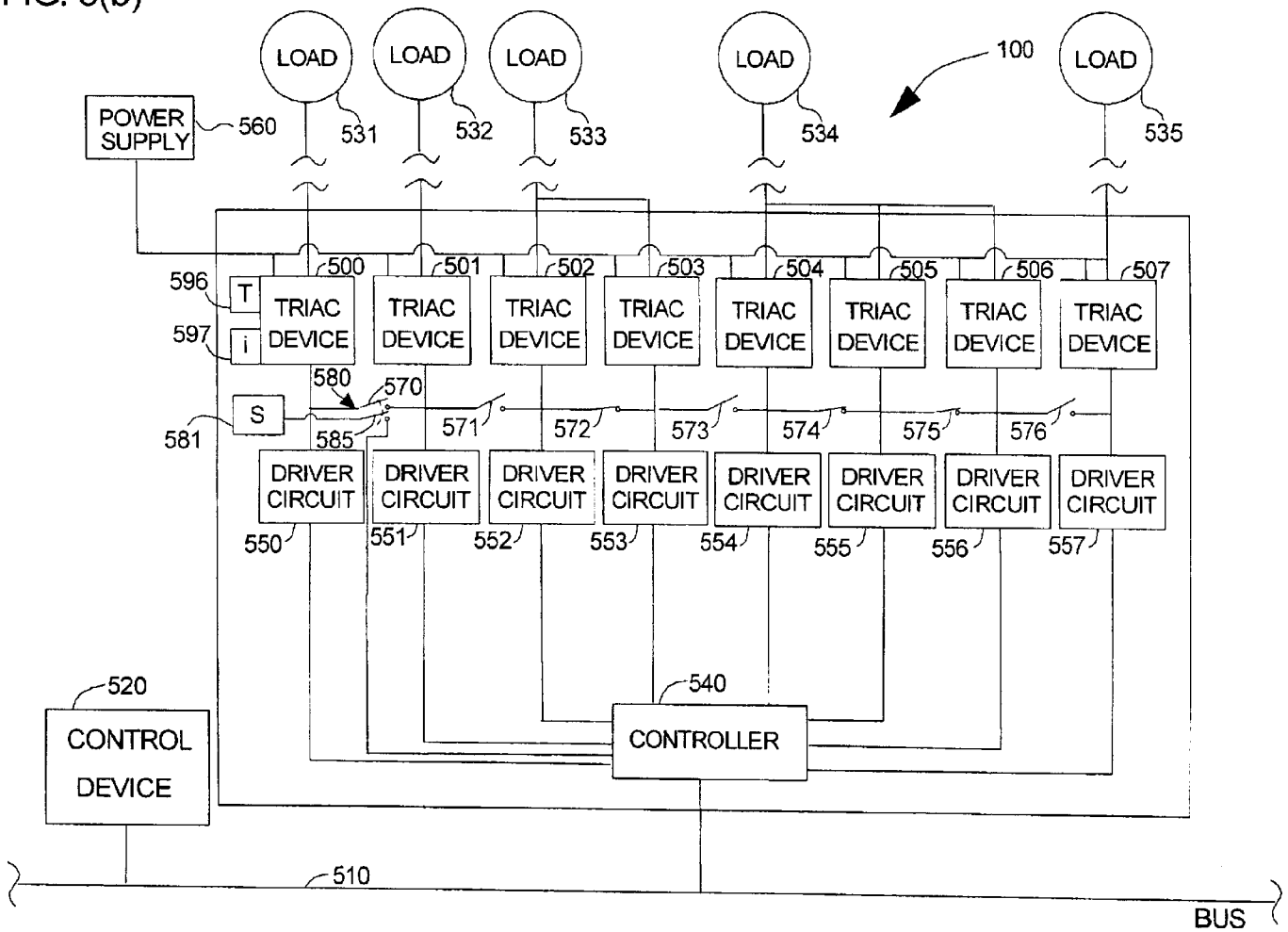

Load control system 100 may be linked in the building automation environment over bus 510 to a control device 520 (e.g., a keypad, a timer, etc.), as shown according to one embodiment in FIGS. 5(*a*) and (*b*). Control device 520 may issue signals to the load control system 100 to control at least one load 530 (e.g., a lighting circuit). For example, when a user presses a key on a keypad, a processor at the keypad generates and issues a signal over bus 510. The load control system 100 receives the signal over bus 510 and responds by adjusting the intensity of the lighting in the room.

More specifically, load control system 100 may comprise at least one controller 540 connected to a plurality of driver circuits 550–557 (hereinafter generally referred to as driver (s) 550). Each driver 550 is connected to one of a plurality of triac devices 500–507 (hereinafter generally referred to as triac(s) 500) on the circuit board 110, which control current to the load(s) 530.

According to the teachings of the invention, load control system 100 may be configured by connecting one or more of the triacs 500 in parallel to one or more loads 530. By way of example, load control system 100 is shown configured in FIG. 5(*a*) having each of the plurality of triacs 500–507 connected in parallel to a single load 530. As another example, load control system 100 is shown in FIG. 5(*b*) configured with individual triacs 500, 501, and 507 connected separately to loads 531, 532, and 535; two triacs 502 and 503 connected in parallel to load 533; and three triacs 504, 505, and 506 connected in parallel to load 534.

Distributing current through a plurality of parallel connected triacs (e.g., as illustrated in the example of FIGS. 5(*a*) and (*b*)) results in better overall performance and increased reliability. Even if one of the parallel connected triacs 500 fails, load control system 100 can still provide power to the load 530 if the other paralleled triacs remain operational. It has also been found that load control system 100 configured with a plurality of parallel connected triacs 500 serves to reduce filament "ringing" during operation.

In addition, it is readily apparent that substantial power savings can be realized by providing current to the load 530 through a plurality of triacs 500 connected in parallel. That is, power (P) is defined as the square of the current (i) flowing through the device times the resistance (R) of the device, or mathematically as $P=i^2R$. As an example, if 4 amps of current are delivered to a load through a single triac, the power (P) consumption is $4^2R$, or 16R Watts. If the same 4 amps is delivered through two triacs connected to the load in parallel (i.e., 2 amps through each triac), the power (P) consumption of each triac is $2^2R$ or 4R Watts, and the total power (P) consumption by both triacs is equal to 2×4R Watts or 8 Watts.

The power savings realized by load control system 100 directly translates to lower heat dissipation requirements. Operating load control system 100 at lower temperatures serves to extend the life of its electronic components, increasing the reliability of load control system 100. The lower heat dissipation requirements also allow the load control system 100 to be operated with smaller heat sinks, without the need for unsightly fins or noisy fans. Eliminating the need for elaborate heat sinks lowers manufacturing costs, and load control system 100 can be installed in more convenient locations (e.g., in walls of the building), reducing wiring and installation costs.

The costs of manufacturing load control system 100 are also reduced by using smaller-size electronic components (e.g., inductor chokes and interference capacitors). In addition to the direct cost savings, the manufacturer's inventory costs are also reduced by stocking same-size components as opposed to having to stock different-size components (e.g., for manufacturing different current capacity triac circuits). In addition to the cost savings, it has been found that the use of multiple, smaller-size inductor chokes and interference capacitors in load control system 100 function to better reduce RFI/EMI noise during operation.

As discussed briefly above and in more detail below, load control system 100 can be readily configured (and reconfigured) for use with a variety of different size loads 530 (see, e.g., FIG. 5(*b*)). Accordingly, the manufacturer does not need to anticipate and manufacture triac circuits for each of the different types of loads that may be encountered. Nor does the installer have to maintain an inventory of different triac circuits for typical installations and run the risk that a particular installation requires a triac circuit that needs to be ordered. Instead, only one (or a limited number of different) load control system(s) 100 need to be manufactured and inventoried by the installer, reducing their cost.

In addition, it is not required that the triacs 500 be arranged in any particular manner to balance the current through the parallel connected triacs, as balancing is achieved by the controller 540 and/or driver circuit(s) 550. Other advantages of load control system 100 will also become readily apparent to one skilled in the art after having become familiar with the teachings of the invention.

Having briefly described load control system according to an embodiment of the invention, as well as some of its features and advantages, embodiments of the invention will now be described in detail.

Load, control system 100 is shown according to one embodiment in FIG. 1 through FIG. 4 as it may used in a building automation environment, although the scope of the invention is not limited to any particular use. In this embodiment, the circuit board 110 is mounted to cover 120 using fasteners 130–133 (e.g., screws), as shown in FIG. 1 and FIG. 2. Cover 120 serves to protect the circuit board 110 from the environment (e.g., dust, moving objects). In addition, cover 120 may also comprise a thermally conductive portion 140 manufactured from aluminum or other thermally conductive material that serves as a heat sink. The control circuitry may be thermally coupled to the heat sink 140 to dissipate heat generated during operation. Connectors 105 (e.g., for linking to power, the bus 510, etc.) are also shown mounted to the circuit board 110.

Triac 500 is shown thermally coupled to the heat sink 140 in FIG. 2. In this embodiment, member 200 is positioned in sleeve 210. Fasteners 220 (e.g., screws) are inserted through an opening formed in the casing of triac 500 and threaded into member 200 to position triac 500 adjacent heat sink 140. Accordingly, heat generated by the triacs 500 during operation of load control system 100 is transferred to the heat sink 140 and dissipated to the surrounding environment.

It is understood that the invention is not limited to use with heat sink 140. In other embodiments, the cover 120 need not comprise a heat sink 140. For example, one or more heat sinks may be provided for the control circuitry independently of cover 120. In other embodiments, a heat sink does not need to be provided at all.

The cover 120 may be mounted to housing 300 so that the circuit board 110 is at least partially enclosed, as shown in FIG. 3. For example, the cover 120 may be mounted to housing 300 using suitable fasteners 230 (e.g., screws, snaps, adhesives) with the heat sink 140 facing away from housing 300 and the circuit board 110 facing housing 300. Housing 300 may also comprise openings 305 formed therein (e.g., for ventilation, power or other cabling, etc.).

Although in one embodiment, housing 300 is manufactured from sheet metal, it is understood that housing 300 may be manufactured from any of a wide variety of other materials (e.g., plastic). It is also understood that cover 120 can be attached to housing 300 in any suitable manner. For example, cover 120 may be attached to housing 300 by hinges, snaps, adhesives, and so forth.

Load control system 100 may be mounted to a building wall 400, as shown according to one embodiment in FIG. 3 and FIG. 4. In this embodiment, housing 300 is shown mounted to a 2×4 wall stud 310. Housing 300 may be mounted to the wall stud 310 using any suitable fastener (e.g., nail plate 320) and may be mounted similar to common electrical outlet boxes using for electrical wiring in buildings. As mentioned above, load control system 100 is preferably mounted to the wall with the heat sink 140 facing outward from the wall so that heat generated during operation can be readily dissipated into the room.

Trim plate 410 may be positioned over the cover 120 for aesthetic purposes. In addition, the heat sink 140 of cover 120 may also be painted (e.g., to match the wall color) according to one embodiment. This is a significant advantage of the present invention, and can be achieved because of the low power consumption of the control circuitry and resulting low temperature rise of heat sink 140 during operation.

Although load control system 100 has been described having cover 120 and housing 300, it is understood that this is merely exemplary of one embodiment that may be used according to the teachings of the present invention. Load control system 100 is not limited to use with any particular type or style of cover or housing.

The control circuitry for load control system 100 will now be described in more detail according to one embodiment with reference to FIGS. 5(*a*) and (*b*). As briefly described above, load control system 100 may be linked over a bus 510 to a control device 520, as shown according to one embodiment in the high-level circuit diagram of FIGS. 5(*a*) and (*b*). According to one embodiment, bus 510 is a controller area network (CAN) bus. Embodiments of a building automation system using a CAN bus is described in co-pending, co-owned U.S. patent application Ser. No. 10/382,979, entitled "BUILDING AUTOMATION SYSTEM AND METHOD" of Hesse, et al., filed on Mar. 5, 2003, which is hereby incorporated herein by reference for all that it discloses.

Briefly, the CAN bus comprises a two-wire differential serial data bus. The CAN bus is capable of high-speed data transmission (about 1 Megabits per second (Mbits/s)) over a distance of about 40 meters (m), and can be extended to about 10,000 meters at transmission speeds of about 5 kilobits per second (kbits/s). It is also a robust bus and can be operated in noisy electrical environments while maintaining the integrity of the data.

The CAN specification is currently available as version 1.0 and 2.0 and is published by the International Standards Organization (ISO) as standards 11898 (high-speed) and 11519 (low-speed). The CAN specification defines communication services and protocols for the CAN bus, in particular, the physical layer and the data link layer for communication over the CAN bus. Bus arbitration and error management is also described. Of course the invention is not limited to any particular version and it is intended that other specifications for the CAN bus now known or later developed are also contemplated as being within the scope of the invention.

It is understood, however, that the present invention is not limited to use with a CAN bus and other types and/or configurations are also contemplated as being within the scope of the invention. For example, the load control system 100 may be used in an Ethernet or a wireless network (e.g., radio frequency (RF), BLUETOOTH™), or accessed via a remote link (e.g., dial-up or Internet connection), to name only a few. In addition, the load control system 100 may be used in a subnet and controlled from another network or subnet. In addition, the control device may be directly linked to the load control system 100 (e.g., as a stand-alone device).

It is also understood that the control device 520 may comprise any node (e.g., a keypad, knob, slider, touch-screen, sensor, clock, etc.) which is generally configured to respond to an event (e.g., receive input and generate a signal based on the received input). By way of example, control device 110 may be a keypad. When the user presses a key (or sequence of keys) on the keypad, one or more signals may be generated that are representative of the key(s) that were pressed.

In one embodiment, the signal may correspond to program code (e.g., scripts) for performing a predetermined function at the load control system 100 (e.g., adjust light intensity to 50%). Embodiments for controlling a device using program code or scripts is described in co-pending, co-owned U.S. patent application entitled "DISTRIBUTED CONTROL SYSTEMS AND METHODS FOR BUILDING AUTOMATION" of Hesse, et al., filed on Apr. 24, 2003 (Attorney Docket No. Colorado vNet US-2; Ser. No. not yet accorded), which is hereby incorporated herein by reference for all that it discloses.

Of course control device 520 is not limited to a keypad or keyboard. Examples of control devices 520 also include, but are not limited to, graphical user interfaces (GUI), personal computers (PC), remote control devices, security sensors, temperature sensors, light sensors, and timers.

In any event, controller 540 of the load control system 100 is preferably responsive to receiving the signal. Controller 540 is linked to each of a plurality of triacs 500–507 (generally referred to as 500) through driver circuits 550–557 (generally referred to as 550). Accordingly, controller 540 receives the signal and actuates the triacs 500 via driver circuits 550, thereby delivering current to the load(s) 530.

In one embodiment, controller 540 is provided with computer-readable program code (e.g., firmware, scripts) stored on suitable computer-readable storage operatively associated with the controller 540. The computer-readable program code for actuating the triacs 500 via driver circuits preferably comprises program code for signaling each driver circuit 550 for the parallel connected triacs at about the same time.

In one embodiment, the computer-readable program code comprises program code for repeatedly signaling each driver circuit 550 for the parallel connected triacs. Preferably, the program code repeatedly signals each driver circuit 550 from one time up to about 255 times during each half AC cycle (i.e., between each zero cross). Accordingly, in the event that one or more of the parallel connected triacs 500 do not actuate, the controller 540 repeatedly attempts to actuate the triacs 500 during the same half AC cycle so that each of the triacs 500 actuates preferably at the same time, but at least at substantially the same time. Actuating each of the triacs 500 at substantially the same time makes it more likely that each of the parallel connected triac 500 will deliver about the same current.

Of course it is understood that the number of times the program code repeatedly signals each driver circuit 550 is not limited to 255 times during each half AC cycle. For example, the number of attempts may also vary based on where in the half AC cycle the triac should be actuated to provide the desired current to the load 530. In other embodiments, program code may be provided that repeatedly signals each driver circuit 550 more frequently, within the constraints imposed by the hardware.

As briefly described above, triacs 500 (or other suitable semiconductor switching devices) can be connected in parallel to control load 530 by connecting one or more gates 570–576 (generally referred to as 570) of the triacs 500 and then connecting the output of each triac to the same load. Accordingly, the load control system 100 can be configured for use with a variety of different loads 530.

For purposes of illustration, load control system 100 is shown configured in FIG. 5(*a*) having each of the plurality of triacs 500–507 connected in parallel to a single load 530. As another example, load control system 100 is shown in FIG. 5(*b*) configured with individual triacs 500, 501, and 507 connected separately to loads 531, 532, and 535; two triacs 502 and 503 connected in parallel to load 533; and three triacs 504, 505, and 506 connected in parallel to load 534.

In one exemplary embodiment, load control system 100 comprises eight triacs 500 that can be connected to power 560 (e.g., a 20 amp supply breaker). In this example, each triac is rated for 8 amps, although in use, each triac only delivers about 2 amps (±10%) of current at 120 Volts AC. Accordingly, load control system 100 operates more efficiently. It is also more robust. For example, if one or more of the triacs are improperly wired (e.g., to deliver more than 2 amps to a load), or if one or more of the other triacs fails, load control system 100 can continue to operate.

Each triac can be connected individually to switch a load of 240 Watts, or two or more of the triacs can be connected in parallel to switch larger loads. According to this embodiment, up to eight triacs can be connected in parallel to switch a total load of about 1920 Watts (e.g., the UL limit for 20 amp service). Of course the invention is not limited to this embodiment, and it is provided merely as illustrative of one embodiment according to the teachings of the present invention.

In any event, the load control system 100 of the present invention may preferably be configured and reconfigured for use with a variety of loads and combinations of loads. Preferably, the triacs 500 can be logically connected to automatically enable an operating arrangement (e.g., two operating arrangements are illustrated in FIGS. 5(*a*) and (*b*)). According to one embodiment, triacs 500 are logically connected by providing controller 540 with the operating arrangement of the triacs 500. For example, controller 540 may be programmed during installation with the triacs 500 to be operated in parallel and/or those to be operated individually. In operation, controller 540 signals the drivers 550 to actuate the triacs 500 based on the logical connections.

It is understood that controller 540 may be provided with the operating arrangement of load control system 100 in any suitable manner. For example, the operating arrangement may be defined in program code (e.g., scripts). In another example, controller 540 may be operated in a current-sensing mode to determine which of the triacs 500 are connected in parallel to the same load, and which of the triacs 500 are connected to individual loads.

In one embodiment, controller 540 may be operatively associated with a sensor circuit 580 to make this determination. An exemplary sensor circuit 580 is shown in FIGS. 5(*a*) and (*b*) comprising double pole switches 585 provided at gates 570 of triacs 500. Although only one double pole switch 585 is shown in FIGS. 5(*a*) and (*b*) for clarity, it is understood that double pole switches 585 may be provided at each of the gates 570.

Double pole switch 585 may be operated (e.g., closed) so that one leg connects the triacs 500 in parallel (e.g., during installation) and another leg connects, by way of example, a signal source 581 (e.g., low voltage signal) to the controller 540. When the triacs 500 are connected in parallel, the state of the switch identifies the parallel connected triacs 500 to the controller 540. For example, when the switch is closed the voltage level detected by controller 540 from the other leg of the switch may change, thereby indicating that the triacs 500 are connected in parallel. Alternatively, other types of signal(s) (e.g., optical) may indicate to the controller 540 which of the triacs 500 are connected in parallel.

Of course a combination sensor circuit and program code definition may also be used to provide controller 540 with the operating arrangement of load control system 100. For example, the operating arrangement determined by the sensor circuit may be compared to the operating arrangement defined in the program code. If the operating arrangements do not match, controller 540 may generate an alert that either the program code should be updated to correspond to the actual operating arrangement, or the hard-wired connections should be changed to correspond to the operating arrangement defined by the program code.

In addition to logically connecting the triacs 500, the gates 570 can also be connected to one another to connect the triacs 500 in parallel. In exemplary embodiments, the gates 570 may be connected with connectors such as jumpers, mechanical switches, electronic switches (e.g., relays), optical switches, hard-wiring, etc. In any event, controller 540 preferably signals the driver circuit(s) 550 for the triacs 500 to actuate the various load(s) 530 connected to load control system 100.

Driver circuits 550 may comprise individual opto-couplers. Opto-couplers are well known in the electronics arts and in one embodiment comprise a light-emitting diode (LED) that can be actuated by a low-voltage signal (e.g., about 20 volts or less) from the controller 540. Light emitted by the LED actuates a phototransistor, and outputs a low-voltage signal from the opto-coupler. Opto-couplers are understood by those skilled in the art, and therefore further description herein is not necessary for a full understanding of the invention.

In the load control system 100, output from the opto-coupler actuates the triac 500. The actuated triac 500 delivers AC current from the power 560 to the load 530. Program code (e.g., scripts) can be provided to adjust the intensity, slew rate, etc. to electronically control the load 530. For example, the slew rate may be adjusted by changing over a period of time the point after zero cross at which the triac turns on.

According to preferred embodiments, at least one of the opto-couplers 550 actuates all of the parallel connected triacs 500 at substantially the same time. Preferably, only one of the opto-couplers 550 actuates all of the parallel connected triacs 500 at substantially the same time. Actuating all of the parallel connected triacs 500 at substantially the same time enables each triac 500 to deliver about the same amount as each of the other parallel connected triacs 500 to the load 530.

It is understood that the control circuitry shown and described herein may also comprise other components not specifically shown or referred to herein. For example, the triacs 500 preferably comprise inductor chokes and interference capacitors. A suitable interface is also preferably provided between the bus 510 and controller 540. Yet other control circuitry may also be provided according to the teachings of the present invention. Such ancillary control circuitry is well-understood and therefore are not shown or described herein as further description is not needed for a full understanding of, or to practice the invention.

Load control system 100 may be provided with an optional status system. In one embodiment, status system may comprise an LED display 595 (see e.g., FIG. 1, FIG. 3, and FIG. 4) to indicate to an installer, administrator, or other user of the status of load control system 100. The status of load control system 100 may indicate normal operation, power off, warning, failure, etc.

Of course it is understood that status system is not limited to an LED display, and other status indicators are also contemplated as being within the scope of the invention. Other exemplary embodiments may comprise generating an audible alert, issuing a signal for remote delivery (e.g., via email or pager to the user), or generating a data entry in an error log, to name only a few.

Output from status system may also generate or otherwise result in an automatic response to a potential or pending problem (e.g., from controller 540). For example, the controller 540 may shut all or a portion of the circuitry of load control system 100 if the temperature or current of one or more of the triacs 500 exceeds a predetermined threshold. Alternatively, if a triac 500 fails or is failing, controller 540 may logically "rewire" load control system 100 so that another triac 500 is used instead of the failed or failing triac 500. In one embodiment, a back-up triac 500 may be connected to the load but not logically wired to the load. That is, the controller 540 does not signal the driver 550 for the backup triac 500 until at least one of the other triacs 500 is taken offline by the controller 540 and signals the driver 550 of the backup triac 500.

Status system may comprise at least one temperature sensor 596 for the load control system 100. A single temperature sensor 596 is shown in FIG. 5(*a*) operatively associated with triac 500 for purposes of illustration, but it is understood that in one embodiment a temperature sensor 596 may be, and preferably is provided for each triac 500. If the operating temperature exceeds a predetermined threshold, the status system may deliver an alert. For example, an operating temperature exceeding the threshold may indicate that one or more of the components on the circuit board 110 has failed or may soon fail. As another example, an operating temperature exceeding the threshold may indicate that the load control system 100 was not properly installed.

Status system may also comprise a current sensor 597 for the load control system 100. Current sensor 597 is shown in FIG. 5(*a*) operatively associated with one of the triacs 500 for purposes of illustration, but it is understood that in one embodiment current sensor 597 may be provided for each triac 500.

Figure 6:
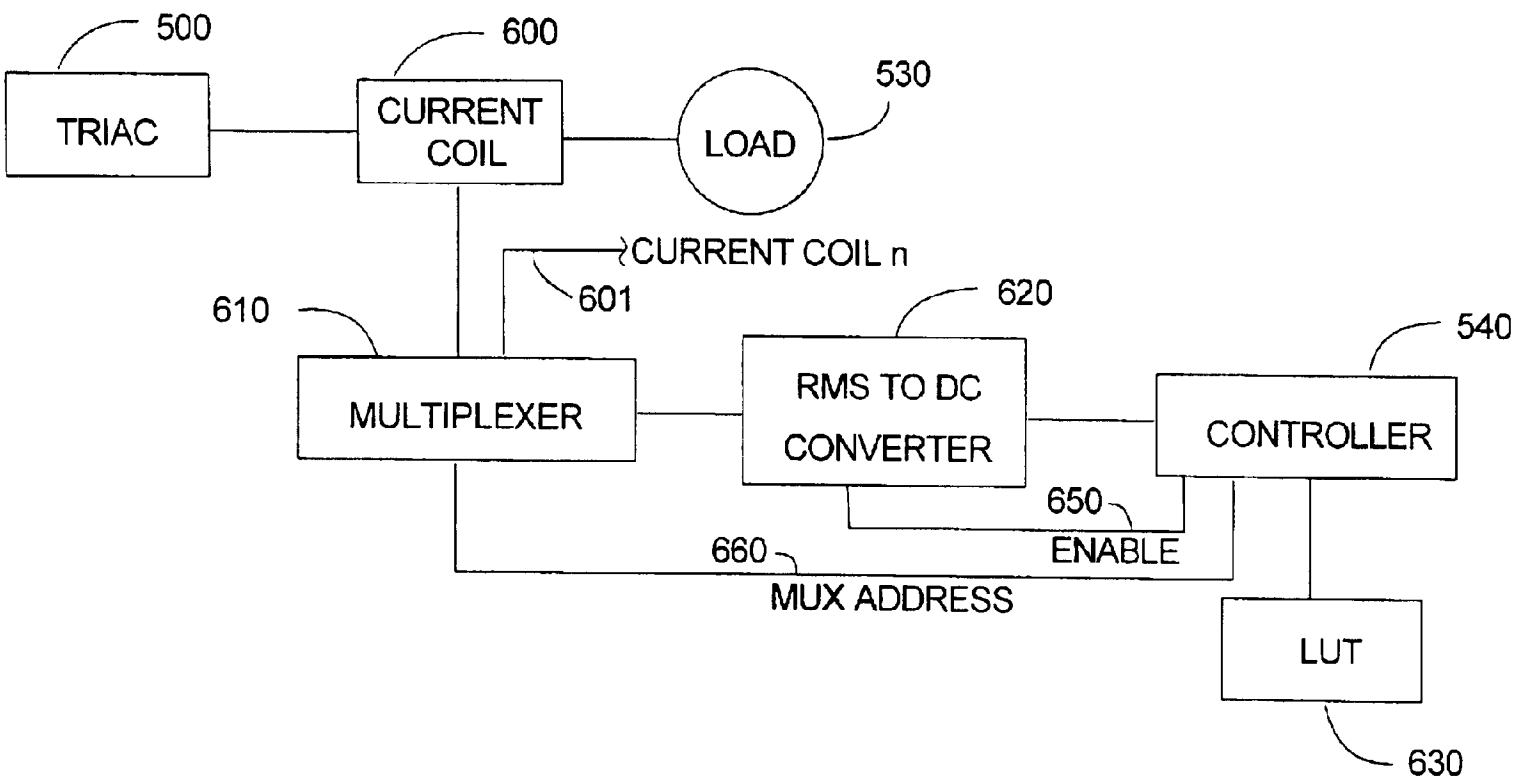
FIG. 6 is a block diagram illustrating one embodiment of a current sensor.

One embodiment of a current sensor 597 is shown in FIG. 6. According to this embodiment, each triac 500 may comprise a current coil 600 (e.g., an additional winding 600 on the inductor choke). Any number of current coils 601 "n" may be provided (e.g., one for each triac). In any event, the current coil(s) outputs VRMS as a function of current through each triac 500 to the load 530. The VRMS of the current coil for each of the triacs 500 is delivered to the controller 540. A multiplexer 610 may be provided to select (e.g., via MUX address 660) output from the current coils 600, for example, where more than one current coil is provided. An RMS to DC converter enable signal 650 may also be provided to fine tune the VRMS measurement time window of the AC signal. The controller 540 enables an RMS to DC converter 620 via enable signal 650 during a predetermined window of the AC signal to integrate the sine wave and filter out unwanted information. Controller 540 accesses a look-up table 630, or otherwise determines (e.g., based on one or more computations, etc.) the power generated by each triac 500, and in turn, determine overload, whether a triac is connected in parallel or individually to a load, a change in the load, or overall power controlled by the eight triacs.

In any event, current sensor 597 detecting a current imbalance through the parallel connected triacs may indicate a malfunction, pending failure, or that the load control system 100 is not properly configured. For example, one of the parallel connected triacs drawing most of the current being delivered to a load may indicate that one of the other triacs has failed or that the triacs were not properly connected in parallel. Current measurements may also be used to determine when a load is failing or has failed (e.g., a light bulb has burned out), and may be used to alert the user (e.g., pinpointing the failed load).

Figure 7A:
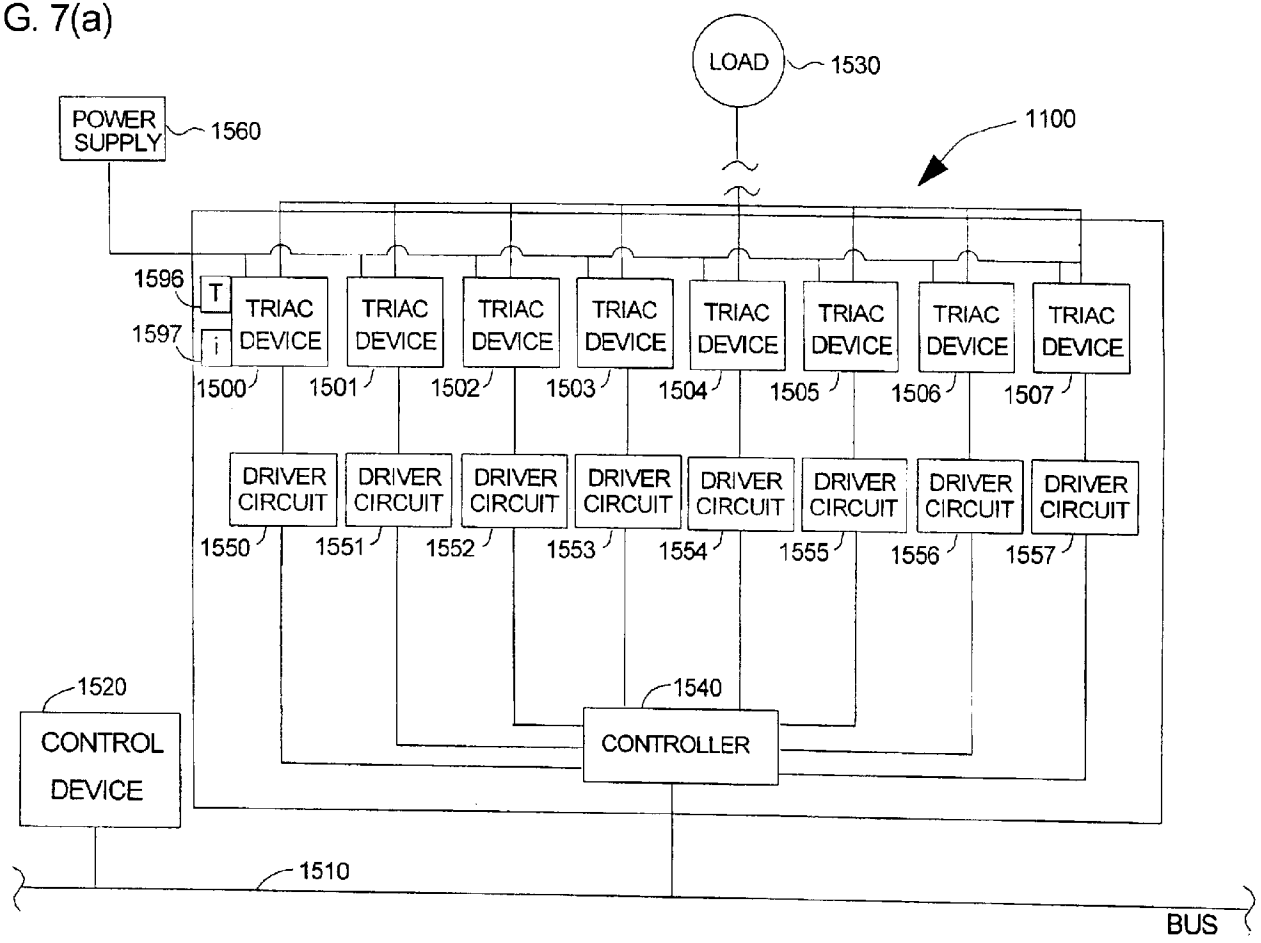
FIGS. 7(*a*) and (*b*) are high-level schematic diagrams of a load control system according to another embodiment of the invention, illustrating the load control system configured to power (a) a single load, and (b) a plurality of loads.
Figure 7B:
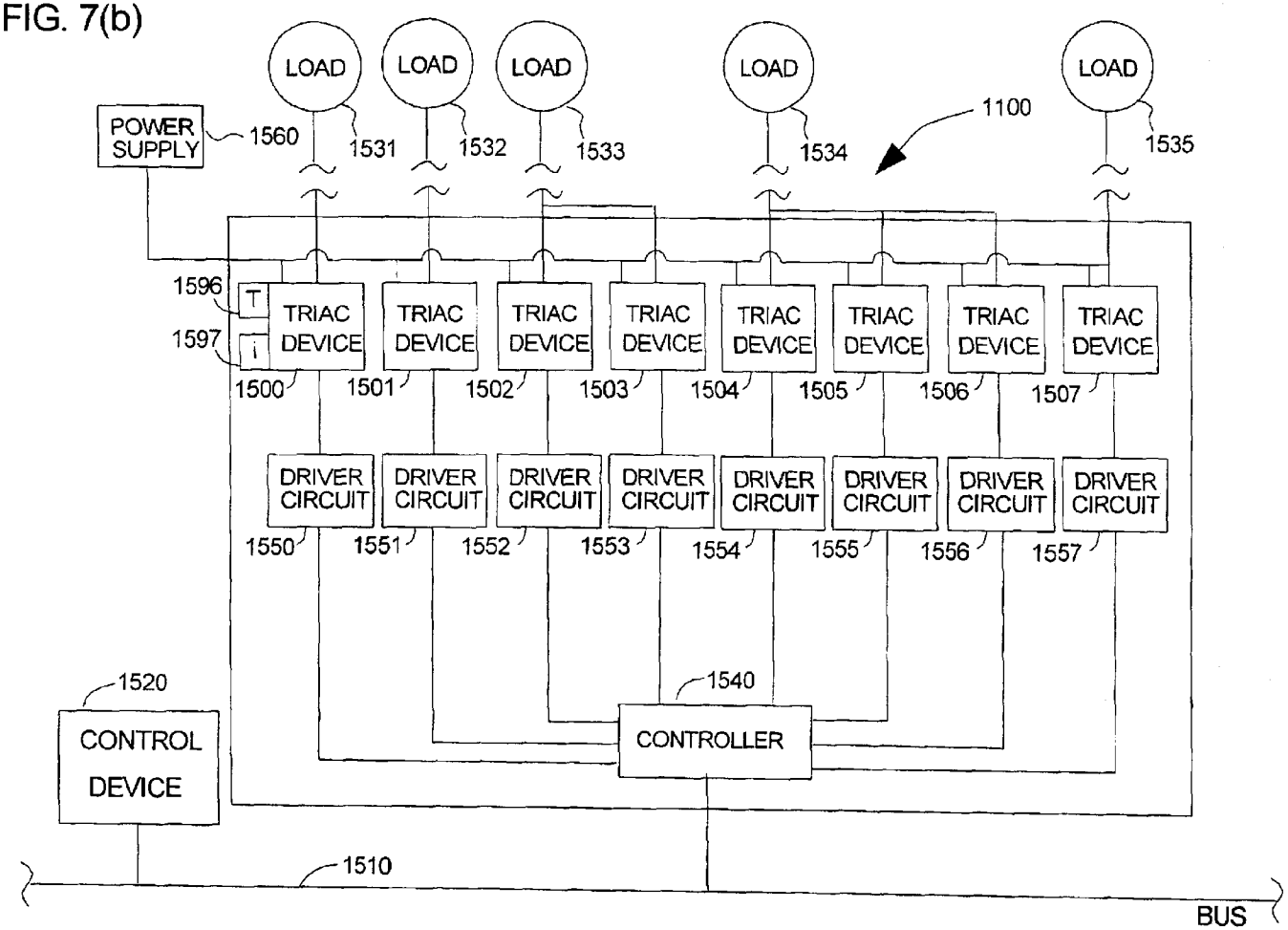

Another embodiment of load control system 1100 is shown in FIGS. 7(*a*) and (*b*). Like elements are shown in the figures using 1000 series reference numbers, and may not be specifically discussed with regard to this embodiment. Again, controller 1540 may be linked to a control device 1520 and is preferably responsive to receiving the signal. Controller 1540 is linked to each of a plurality of triacs 1500–1507 (generally referred to as 1500) through driver circuits 1550–1557 (generally referred to as 1550). Preferably in this embodiment, driver circuits 1550–1557 are pulse transformers, as discussed in more detail below. According to this embodiment, controller 1540 receives the signal and actuate the triacs 1500 via driver circuits 1550, thereby providing current to the load(s) 1530.

The triacs 1500 can be connected in parallel to load 1530 by connecting the output of each triac 1500 to the same load. It is noted, however, that the gates of the parallel connected triacs 1500 are preferably not connected in this embodiment. Again, the load control system 1100 can be configured for use with a variety of different loads 1530.

For purposes of illustration, load control system 1100 is shown configured in FIG. 7(*a*) having each of the plurality of triacs 1500–1507 connected in parallel to a single load 1530. As another example, load control system 1500 is shown in FIG. 7(*b*) configured with individual triacs 1500, 1501, and 1507 connected separately to loads 1531, 1532, and 1535; two triacs 1502 and 1503 connected in parallel to load 1533; and three triacs 1504, 1505, and 1506 connected in parallel to load 1534.

Driver circuits 1550 may comprise pulse transformers. Pulse transformers are well known and use electromagnetic induction to generate a low-voltage (e.g., about 20 volts or less) output signal. Pulse transformers are understood by those skilled in the art, and therefore further description is not necessary for a full understanding of the invention.

In the load control system 1100, output from the pulse transformer actuates the triac 1500. On actuating, the triac 1500 delivers AC current from the power 1560 to the load 1530.

According to preferred embodiments, each of the pulse transformers 1550 actuates all of the parallel connected triacs 1500 at substantially the same time. Actuating all of the parallel connected triacs 1500 at substantially the same time enables each triac 1500 to deliver about the same amount as each of the other parallel connected triacs 1500 to the load 1530.

Preferably, the triacs 1500 are logically connected to automatically enable an operating arrangement (e.g., two operating arrangements are illustrated in FIGS. 7(*a*) and (*b*)), as discussed above. According to one embodiment, triacs 1500 are logically connected by providing controller 1540 with the operating arrangement of the triacs 1500. For example, controller 1540 may be programmed during installation with the triacs 500 to be operated in parallel and/or those to be operated individually, as described above. In operation, controller 1540 signals the drivers 1550 to actuate the triacs 1500 based on the logical connections.

It is readily apparent that embodiments of the present invention represent an important development in the field of electrical control circuitry in general, and more specifically to electrical control circuitry for building automation. However, it is also understood that load control system 100 of the present invention is not limited to use in building automation environments. Load control system may also be used in other environments, including but not limited to industrial or manufacturing environments.

Having herein set forth preferred embodiments of the present invention, it is anticipated that suitable modifications can be made thereto which will nonetheless remain within the scope of the present invention.

What is claimed is:

1. A configurable system for controlling at least one load, comprising:

a circuit board;

a plurality of triac devices mounted on said circuit board;

a plurality of connectors operatively associated with said plurality of triac devices, said plurality of connectors selectively connecting at least one of said plurality of triac devices in parallel with at least one other of said plurality of triac devices to said at least one load;

plurality of driver circuits provided on said circuit board, each of said plurality of driver circuits connected to each of said plurality of triac devices, at least one of said plurality of driver circuits operable to actuate each of said plurality of triac devices connected in parallel at about the same time to balance the total current delivered to the at least one load substantially equally through each of said plurality of triac devices connected in parallel.

2. The configurable system of claim 1, further comprising a controller operatively associated with said plurality of driver circuits, said controller signaling at least one of said plurality of driver circuits to actuate each of said triac devices selectively connected in parallel.

3. The load control system of claim 2, wherein said controller logically connects the selected triac devices in parallel.

4. The configurable system of claim 1, wherein at least one of said plurality of driver circuits comprises an optocoupler.

5. The configurable system of claim 1, wherein at least one of said plurality of driver circuits comprises a pulse transformer.

6. The configurable system of claim 1, further comprising a housing and a cover, said circuit board mounted to said cover and at least partially enclosed in said housing.

7. The configurable system of claim 1, further comprising a painted cover, said circuit board mounted to said painted cover.

8. The load control system of claim 1, further comprising at least one heat sink thermally coupled to said plurality of triac devices.

9. A load control system, comprising:

at least two triac devices connected in parallel to a load, said at least two triac devices operable to deliver current to the load;

at least one driver circuit linked to said at least two triac devices;

a controller linked to said at least one driver circuit, said controller signaling said at least one driver circuit to actuate said at least two triac devices at about the same time; and program code operativey associated with said controller, said program code for signaling said at least one driver circuit up to about 255 times every half AC cycle to actuate each said at least two triac devices connected in parallel.

10. The load control system of claim 9, wherein said at least two triac devices are connected in parallel logically by said controller.

11. The load control system of claim 9, further comprising a sensor circuit operatively associated with at least said two triac devices and with said controller, said sensor circuit indicating an operating arrangement of the load control system to said controller.

12. The load control system of claim 9, further comprising program code operatively associated with said controller, said program code for defining an operating arrangement of the load control system.

13. The load control system of claim 9, wherein said controller is operatively associated with a CAN bus, said controller signaling said at least one driver circuit in response to a signal over said CAN bus.

14. The load control system of claim 9, wherein said controller repeatedly signals said at least one driver circuit to actuate said at least two triac devices.

15. The load control system of claim 9, further comprising a status system operatively associated with said controller, said status system indicating a status of the load control system.

16. The load control system of claim 15, wherein said status system further comprises at least one temperature sensor.

17. The load control system of claim 15, wherein said status system further comprises at least one current sensor.

18. The load control system of claim 9, further comprising at least one triac device connected individually to another load.

19. A load control system, comprising:

at least two triac devices connected in parallel to a load, said at least two triac devices operable to deliver current to the load;

at least one driver circuit linked to said at least two triac devices; and a controller linked to said at least one driver circuit and operatively associated with a CAN bus, said controller signaling said at least one driver circuit to actuate said at least two triac devices at about the same time in response to receiving a signal over said CAN bus.

20. The load control system of claim 19, wherein said at least two triac devices are connected in parallel logically by said controller.

21. The load control system of claim 19, further comprising a sensor circuit operatively associated with at least said two triac devices and with said controller, said sensor circuit indicating an operating arrangement of the load control system to said controller.

22. The load control system of claim 19, further comprising program code operatively associated with said controller, said program code for defining an operating arrangement of the load control system.

23. The load control system of claim 19, further comprising program code operatively associated with said controller, said program code for signaling said at least one driver circuit to actuate each said at least two triac devices connected in parallel.

24. The load control system of claim 23, wherein said program code signals said at least one driver circuit up to about 255 times every half AC cycle.

25. The load control system of claim 19, wherein said controller repeatedly signals said at least one driver circuit to actuate said at least two triac devices.

26. The load control system of claim 19, further comprising a status system operatively associated with said controller, said status system indicating a status of the load control system.

27. The load control system of claim 26, wherein said status system further comprises at least one temperature sensor.

28. The load control system of claim 26, wherein said status system further comprises at least one current sensor.

29. The load control system of claim 19, further comprising at least one triac device connected individually to another load.

30. A system for controlling at least one load with a plurality of triac devices, comprising:

means for logically connecting the plurality of triac devices in parallel;

actuating means for actuating the plurality of semiconductor switching devices connected in parallel at about the same time to balance the total current delivered to the at least one load substantially equally through each of the plurality of triac devices connected in parallel; and program code means for signaling said actuating means up to about 255 times every half AC cycle for actuating each of said plurality of triac devices.

31. A system for controlling at least one load with a plurality of triac devices, comprising:

means for logically connecting the plurality of triac devices in parallel; and actuating means for actuating the plurality of semiconductor switching devices connected in parallel at about the same time to balance the total current delivered to the at least one load substantially equally through each of the plurality of triac devices connected in parallel; and controller means operatively associated with a CAN bus for signaling said actuating means in response to receiving a signal over said CAN bus.

32. A method for controlling at least one load, comprising:

reconfigurably connecting at least one triac device in parallel with at least one other triac device for providing current to the at least one load;

actuating each of said plurality of triac devices connected in parallel at about the same time to balance the total current delivered to the at least one load substantially the same portions through each of said plurality of triac devices connected in parallel; and repeatedly signaling each of said plurality of triac devices connected in parallel up to about 255 times during each half AC cycle.

33. The method of claim 32, wherein reconfigurably connecting at least one triac device in parallel with at least one other triac device at least logically connects the triac devices in parallel.

* * * * *

UNITED STATES PATENT AND TRADEMARK OFFICE

CERTIFICATE OF CORRECTION

PATENT NO. : 6,927,546 B2
DATED : August 9, 2005
INVENTOR(S) : Adamson et al.

It is certified that error appears in the above-identified patent and that said Letters Patent is hereby corrected as shown below:

Column 5,
Line 11, "boxes using for" should be -- boxes used for --.

Column 6,
Lines 27-28, delete "co-owned U.S. patent application entitled 'DISTRIBUTED CONTROL SYSTEMS AND METHODS FOR BUILDING AUTOMATION' of Hesse, et al., filed on Apr. 24, 2003 (Attorney Docket No. Colorado vNet US-2; Ser. No. not yet accorded)" and insert -- co-owned U.S. patent application no. 10/422,525 filed on Apr. 24, 2003 and entitled "Distributed Control Systems and Methods" of Hesse, et al. --.

Column 11,
Line 13, "triacs 500" should be -- triacs 1500 --.
Line 39, "plurality of driver circuits" should be -- a plurality of driver circuits --.

Column 13,
Lines 32-33, delete "semiconductor switching devices" and insert -- triac devices --.

Column 14,
Lines 9-10, delete "semiconductor switching devices" and insert -- triac devices --.

Signed and Sealed this

Seventh Day of March, 2006

JON W. DUDAS
*Director of the United States Patent and Trademark Office*